US006364473B1

(12) United States Patent
Liu

(10) Patent No.: US 6,364,473 B1
(45) Date of Patent: Apr. 2, 2002

(54) REFILLING NEEDLE FOR REFILLING AN INK CARTRIDGE

(76) Inventor: Win-Yin Liu, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 09/827,235

(22) Filed: Apr. 6, 2001

(51) Int. Cl.[7] ..... B41J 2/175

(52) U.S. Cl. ..... 347/85; 141/18; 141/198; 141/290

(58) Field of Search ..... 347/85, 86, 87, 347/92; 141/18, 114, 198, 290

(56) References Cited

U.S. PATENT DOCUMENTS 3,941,171 A * 3/1976 Ogle ..... 141/309
4,968,998 A * 11/1990 Allen ..... 347/7
5,479,968 A * 1/1996 Sanchez et al. ..... 141/110
6,172,695 B1 * 1/2001 Liu ..... 347/85
6,213,597 B1 * 4/2001 Liu ..... 347/85
6,238,042 B1 * 5/2001 Kobayashi et al. ..... 347/86

* cited by examiner

*Primary Examiner*—Michael Nghiem
(74) *Attorney, Agent, or Firm*—Troxell Law Office PLLC

(57) ABSTRACT

A refilling needle for refilling an ink cartridge, which includes a needle seat, and one end thereof has a convection hole to be connected with a container, while the other end thereof is mounted with two syringe needles (a long needle and a short needle); one end of each syringe needle is furnished with a cut; after the needle seat is connected with the connector of a container, the two syringe needles will be set in the ink-storage sponge in the ink chamber of the ink cartridge; when the container is squeezed, the two syringe needles will provide a convection effect to cause the ink to refill into the ink cartridge.

5 Claims, 4 Drawing Sheets

REFILLING NEEDLE FOR REFILLING AN INK CARTRIDGE

BACKGROUND OF THE INVENTION

1. Field of the Invention

This invention relates to an ink cartridge of a jet printer, and particularly to a refilling needle for refilling an ink cartridge.

2. Description of the Prior Art

In the conventional jet printer, the ink is loaded in a cartridge, and the ink jetted on the printing paper is controlled with a sprayer; when ink in the cartridge is used up, the cartridge has to be replaced for further printing operation; however, the ink cartridge supplied by the original manufacturer is considerably expensive, i.e., a user to print a lot of papers will spend a lot of money.

In the conventional ink cartridge of a jet printer, the ink chamber of the ink cartridge is usually loaded with an equalization air bladder or a piece of sponge for soaking and supplying ink. The ink cartridge supplied by the original manufacturer usually has an equal pressure in the ink chamber during the automatic manufacturing process, and there will be no leak during printing operation.

In the conventional ink cartridge loaded with a sponge, an empty ink cartridge can be replenished by sealing and closing the end opening of the output port by means of a glue paper; then, a center through hole on lid of the top surface of the ink cartridge is sealed with a membrane; a syringe is sucked with a suitable amount of ink. A slender hollow needle is used to stab through the membrane on the through hole, and to the most lower portion of the storage chamber so as to inject ink in the storage chamber; however, the sponge in the storage chamber contains a great amount of bubbles, and the ink injected is unable to exhaust the air therein; as a result, the ink injected in is limited. Since there is a mesh furnished between the storage chamber and the second chamber, if air in the second chamber is unable to exhaust, the ink in the storage chamber will be unable to enter the second chamber via the mesh, and the ink will be unable to flow into the spraying chamber.

When the ink cartridge on a printer fails to print continuously, the major cause is that the sprayer in the printing head is in short supply of ink, i.e., lack of sufficient ink flowing through the passage defined by the bearing member; in other words, if too much air enters the second chamber in the printing head, such air would enter the storage chamber of the sprayer to cause interruption of ink, i.e., having no ink to spray out; in the event of no ink to spray out of the sprayer for a considerable time, the sprayer might be burned out.

In the former application No. 09/328,378, "An apparatus for the ink cartridge of a jet printer" of the applicant, now abandoned, which mainly comprises an ink-storage container and a cylinder; the ink-storage container has a cylindrical body portion, of which the bottle mouth is furnished with a retaining ring and screw threads to be connected with a piston ring and a threaded cap respectively so as to store ink; one end of the cylindrical body portion is furnished with an outer body portion having a large diameter; the cylindrical body portion and the inner cylinder of the cylinder are assembled together; the piston ring of the bottle mouth is in close contact with the inner cylinder; the front end of the sealed surface of the cylinder is furnished with a tapered ink straw to be plugged and connected with a through hole of the ink cartridge; hold the outer surface of the cylinder, and then the thumb pushes the shoulder portion of the ink-storage container upwards so as to generate a negative pressure for replenishing ink into the ink cartridge.

SUMMARY OF THE INVENTION

The prime feature of the present invention is to provide a long and a short syringe needles mounted, through a connector, on an ink container of an ink cartridge; the container is loaded with an ink-storage sponge; the two syringe needles are directly plugged into the ink-storage sponge; when the container is squeezed, the ink will be refilled in by means of a convection effect. As soon as the ink level is raised up to the cut on the end of the short syringe needle, the convection refilling of ink will be discontinued automatically.

Another feature of the present invention is that the method of using the long and short syringe needles to refill ink into the ink cartridge would not cause ink to overflow because of squeezing the ink bottle.

Still another feature of the present invention is that the method of using the long and short syringe needles to refill the ink cartridge is an infiltration method; the refilling is done in accordance with the sucking force of the ink-storage sponge, and the ink refilled would not result in a high pressure in the ink chamber, which usually causes overflow.

A further feature of-the present invention is that the method of using the long and short syringe needles to refill ink can have the refilling needles plugged directly into the ink-storage sponge of the ink cartridge; then, slightly squeeze the ink bottle once, and release the ink bottle; then, a convection refilling will continue between the refilling needles and the ink-storage sponge.

A still further feature of the present invention is that when use the long and short syringe needles to refill the ink cartridge, the cut of the long syringe needle can plug into the ink-storage sponge; when the ink level raises to a height equal to the cut of the short syringe needle, the convection refilling operation will be discontinued automatically; therefore, the ink level can be designed and set in advance.

Yet another feature of the present invention is that the refilling needle assembly includes two syringe needles, which are mounted on a needle seat together in parallel; the width of the two syringe needles is slightly less than the diameter of the refilling hole so as to facilitate the refilling needles to plug into the ink-storage sponge of the ink cartridge easily.

DETAILED DESCRIPTION OF THE PREFERRED EMBODIMENT

Figure 1:
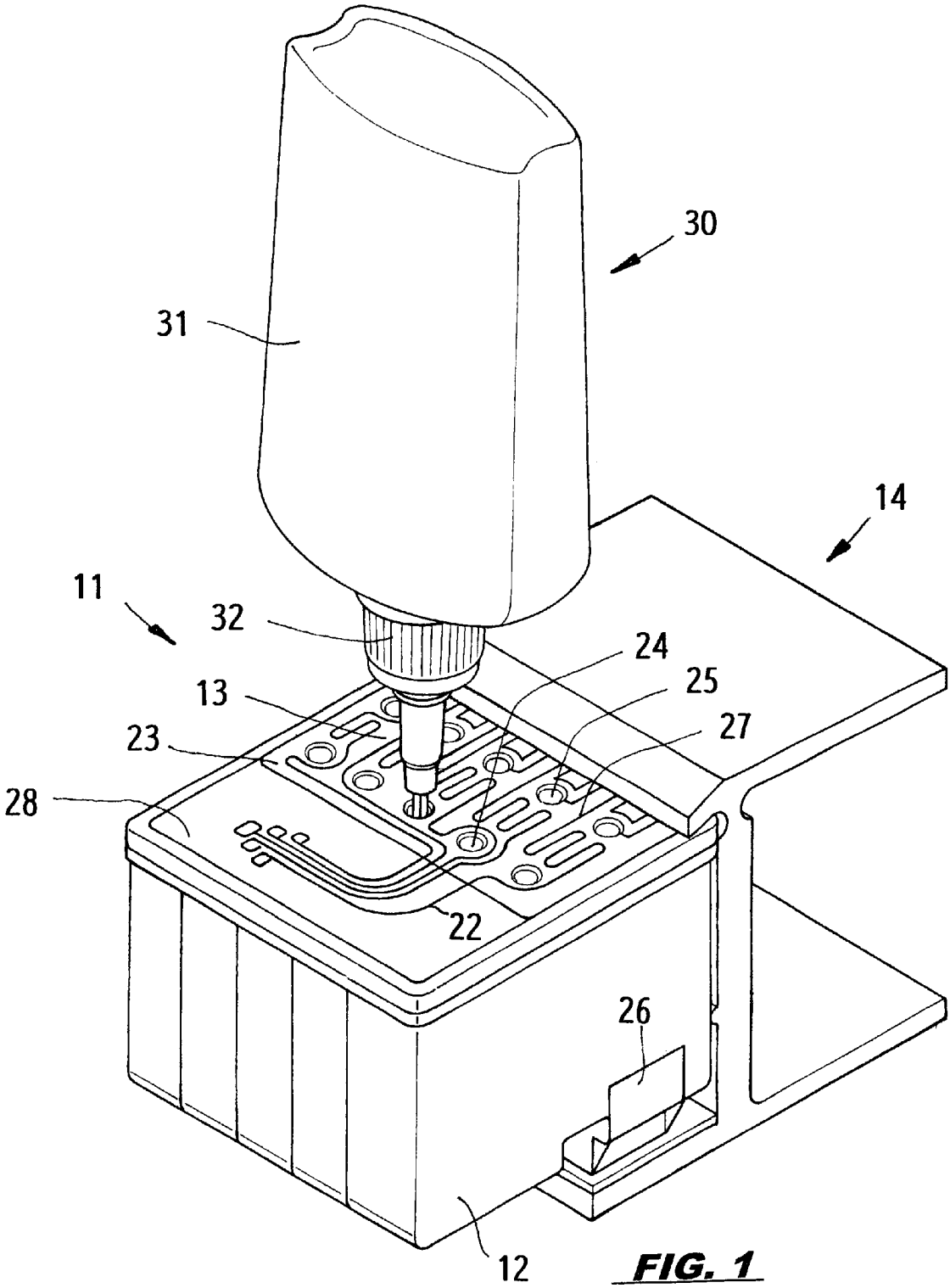
FIG. 1 is a perspective view of the present invention, showing an ink cartridge connected together with an ink cylinder for refilling ink.
Figure 2:
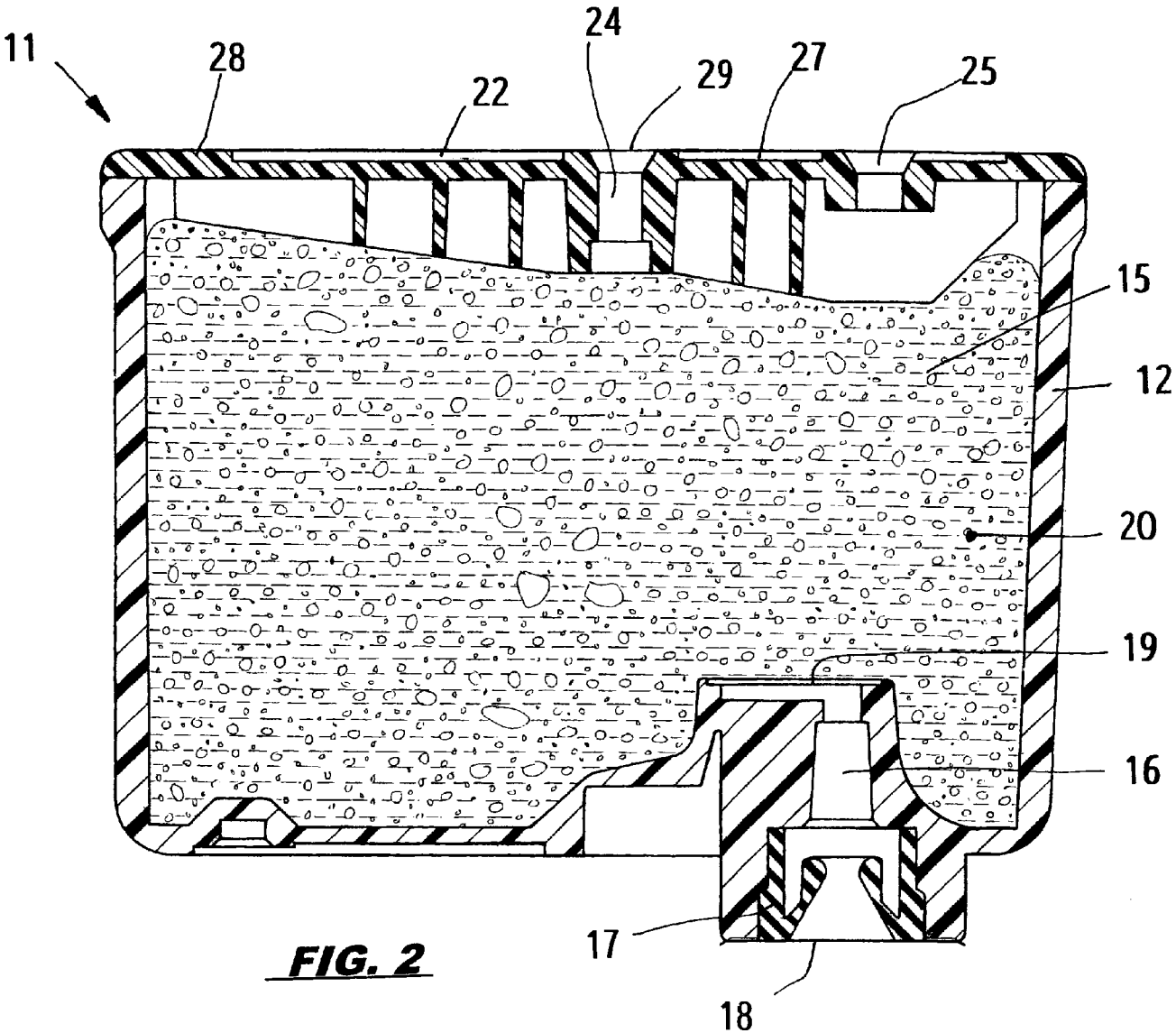
FIG. 2 is a sectional view of the present invention, showing the inner structure of the ink cartridge.

Referring to FIGS. 1 to 2, an ink cartridge 11 of Epson color jet printer (S020110) is shown. The inner space of the body part 12 of the ink cartridge 11 includes several isolated ink-storage chambers 15 in accordance with different colors of ink; every ink-storage chamber 15 is loaded with a sponge 20; the lower part of every ink-storage chamber 15 is mounted with a mesh 19 to isolate the second chamber 16 so as to prevent the impurities of ink in the ink-storage chamber 15 from entering the second chamber 16. By means of siphon effect, the ink can flow into the second chamber 16 of each ink-storage chamber 15; the second chamber 16 is not a large one. When assembling the ink cartridge 11, a hermetic gasket 17 is first mounted in the second chamber 16 on the output port of the ink cartridge 11; the end opening thereof is sealed with an isolation film 18, and then a sponge 20 is loaded in the ink-storage chamber 15 of every body part 12. The top of the body part 12 is sealed with a cap, of which the top surface 28 is furnished with a plurality of maze grooves 22 in accordance with the corresponding number of the ink-storage chambers 15. The tail end of every maze groove 22 has a through hole 25 in communication with the chamber 15, and another through hole 24 for replenishing ink, i.e., the top surface 28 is furnished with two through holes 24 and 25; the prime object thereof is that the through hole 24 is used for plugging an ink needle into the sponge 20. The ink needle and the through hole 24 are connected together hermetically; the other end of the through hole 25 is connected hermetically with an independent connector of a vacuum sucking assembly. The ink can be directed to flow into the sponge 20 in the ink-storage chamber 15 of the ink cartridge 11 by means of a vacuum sucking force of a vacuum sucking assembly, and simultaneously the air in the sponge 20 and the second chamber 16 will be exhausted. After the top surface 28 of the cap on the ink cartridge 11 is sealed thermally with a membrane 23, the two through holes 24 and 25, and the maze groove 22 will be formed into a maze passage 27. The ink storage chamber 15 of the ink cartridge 11 will be in communication with the atmosphere via the fine maze passage 27. The sponge 20 in the ink-storage chamber 15 provides a function of sucking ink and of balancing the inner pressure of the ink-storage chamber 15. Before the ink cartridge 11 being used, the maze passage 27 of the top surface 22 would not cause ink to be leaked out After the ink cartridge 11 and the printer are assembled together, the isolation film 18 attached to the output port will be stabbed through by the guide straw of the connecting seat; then, the hermetic gasket 17 of the output port will be in close contact with the guide straw of the connecting seat. The ink soaked in the sponge 20 of the ink-storage chamber 15 will be consumed and reduced upon printing operation being under way until the sponge 20 unable to supply ink via the mesh 19 and to enter the second chamber 16; then, the ink cartridge should be replaced with a new one so as to provide the printer with ink continuously.

In fact, the isolation film 18 attached to the output port will be broken upon replenishing ink for the ink cartridge 11 with sponge 20. After the ink cartridge 11 is separated from the connecting seat of the printer, air will enter the second chamber 16 of the ink cartridge 11. When replenishing ink, the output port of the ink cartridge 11 must be sealed with a glue paper 26, which is glued over the isolation film 18. In order to seal the output port of the ink cartridge 11 surely, a protection clamp 14 is used during replenishing ink so as to have the output port sealed correctly.

Referring to FIGS. 1 to 5, after an ink cartridge 11 of the jet printer is empty, the output port of the second ink chamber 15 of the ink cartridge 11 will be sealed with a glue paper 26 first; the output port of the ink cartridge 11 is clamped with a protection clamp 14 as shown in FIG. 1 to prevent the ink cartridge 11 from leaking ink. Use a thumb pin or the like to stab a hole in the membrane 29 on the through hole 24 of the ink cartridge 11 first, and then let a refilling needle assembly 13 of the ink bottle 30 plug into the ink storage sponge 20 of the ink cartridge 11 via the through hole 24; then, press the ink bottle 30 to have ink therein flowed into the ink-storage sponge 20 via the cut 38 of a long syringe needle 36. After pressure to the ink bottle 30 is released, the ink in the bottle 30 will continue to flow into the ink-storage sponge 20 by means of a short syringe needle 37, which can draw in air to provide a convection effect to ink; such convection effect can be done repeatedly until the ink in the ink chamber 15 of the ink cartridge 11 raising to a level equal to the cut 39 on the end of the short syringe needle 37, i.e., the convection effect will stop and the ink cartridge will be refilled.

Figure 3:
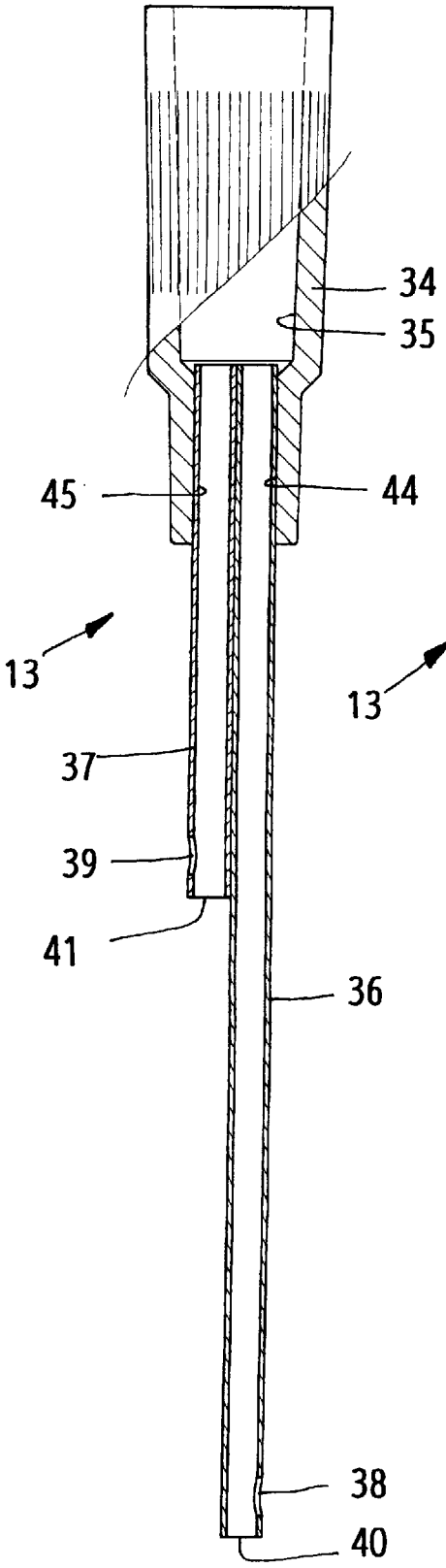
FIG. 3 is a sectional view of the present invention, showing the structure of a refilling needle assembly made of the metal.
Figure 4:
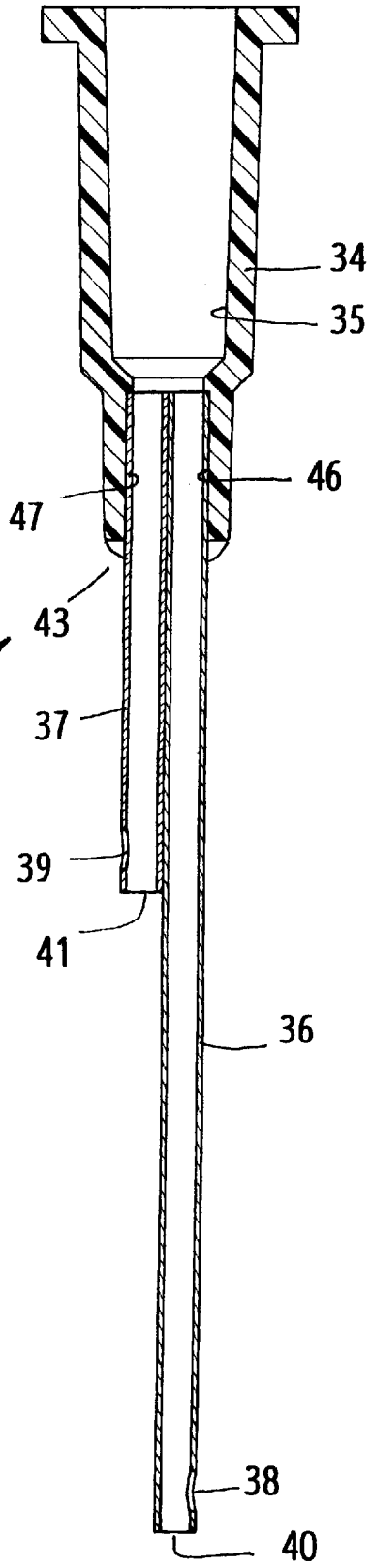
FIG. 4 is a sectional view of the present invention, showing the structure of a refilling needle assembly made of plastics.
Figure 5:
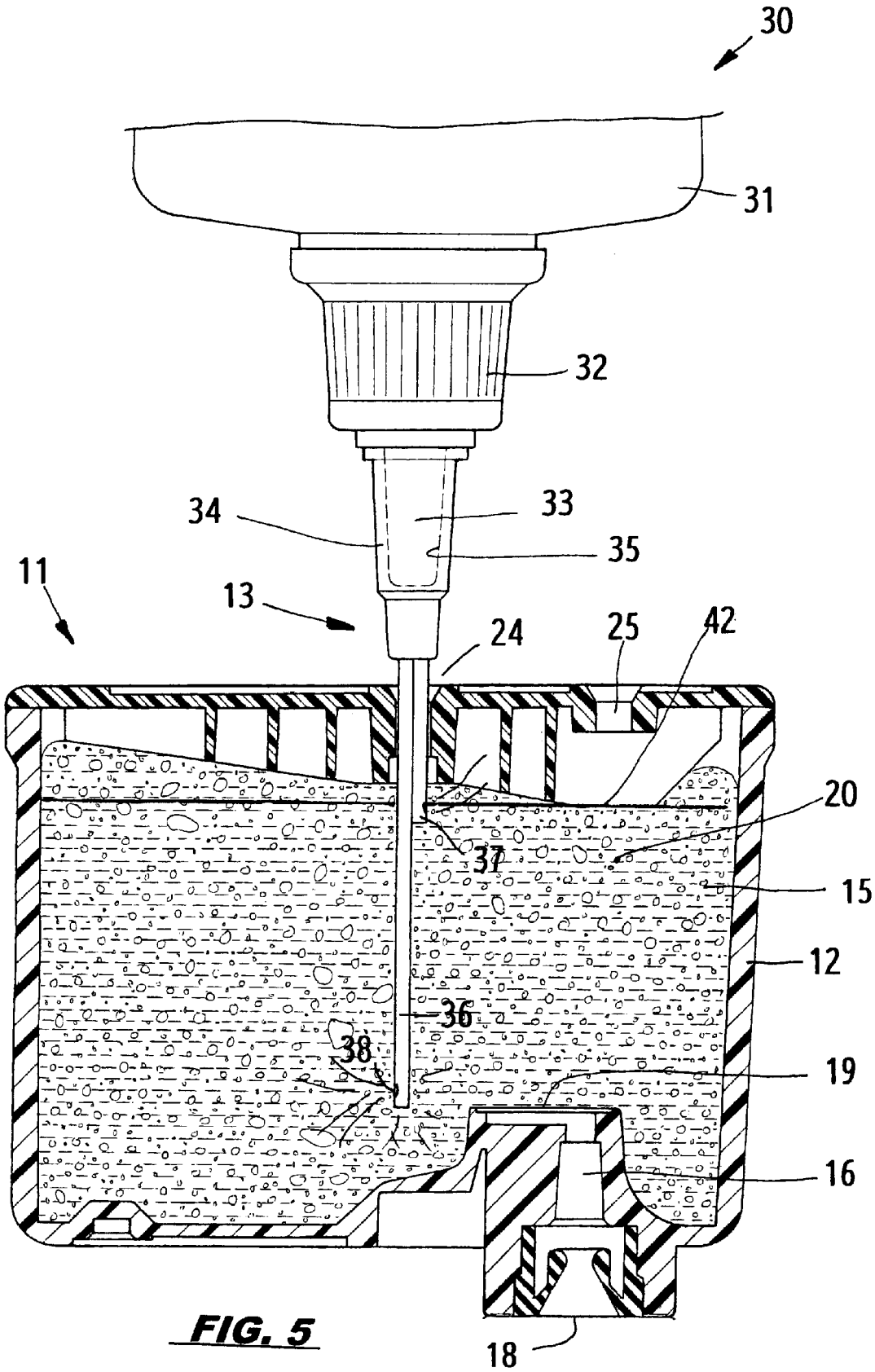
FIG. 5 is a sectional view of the present invention, showing a convection refilling needle assembly in the ink cartridge for refilling ink.

The refilling needle assembly 13 of the ink cartridge 11 includes a needle seat 34, a long syringe needle 36 and a short syringe needle 37; if the long syringe needle 36 is mounted on a conventional needle seat 34 made of plastics or metal as shown in FIG. 3, one end of the needle seat 34 is furnished with a tapered connection hole 35, which can facilitate the connector 33 of a bottle cap 32 of the ink bottle 30 to assembly and disassemble. The other end of the needle seat 34 is furnished with two round holes 44 and 45, which are almost in tangent touching; the two round holes are used for mounting the long and short syringe needles 36 and 37 respectively; through a given punch pressure, the needles will be set in the needle seat 34 firmly as one unit. As shown in FIG. 4, one end of a plastic needle seat 34 of the refilling needle assembly 13 is furnished with a connection hole 35, while the other end thereof has a plug hole 43, which includes two round holes 46 and 47 in tangent touching each other so as to receive a long and a short syringe needles 37 and 38 respectively, and then they are glued in place as one piece.

As shown in FIGS. 1 to 5, the two syringe needles 36 and 37 are mounted in the needle seat 34 firmly as one piece; the outer end of the needle seat 34 has two needles in parallel, but the length of the two needles is different; the length of the long syringe needle 36 is designed to fit the inside height of the ink chamber 15 of the ink cartridge 11. After the refilling needle assembly 13 is plugged into the ink chamber 15 of the ink cartridge 11, the end part 40 of the long syringe needle 36 should be as close as passable to the bottom of the ink chamber 15. The length of the short syringe needle 37 should be long enough to contact with the top surface of the ink-storage sponge 20, or to plug into the sponge slightly. The end parts 40 and 41 of the two syringe needles 36 and 37 are furnished with two cuts 38 and 39 respectively; during refilling ink, the cut 38 of the long syringe needle 36 is used for supplying ink; and the cut 39 of the short syringe needle 37 above the ink-storage sponge 20 is used for supplying convection air into the bottle body 31 of the ink bottle 30.

In the two syringe needles 36 and 37, two ends of them are connected together with the needle seat 34, while the length of other ends thereof are different in accordance with the height of the ink-storage sponge 20 of the ink cartridge 11. The width of the two syringe needles 36 and 37 is slightly smaller than the diameter of the through hole 24 on the ink cartridge 11 so as to facilitate the two syringe needles 36 and 37 to pass the through hole 24 easily; the long syringe needle 36 is plugged into the ink-storage sponge 20, while the end part 41 of the short syringe needle 37 is just in contact with the top surface of the ink-storage sponge 20, or is plugged slightly into the ink-storage sponge 20. The level of the cut 39 of the short syringe needle 37 is designed as the highest level 42 of ink convection operation of the ink chamber 15 of the ink cartridge 11; in other words, the height of the refilling needle assembly 13 plugged into the ink-storage sponge is related to the maximum capacity of the ink cartridge 11.

The two syringe needles 36 and 37 of the refilling needles assembly 13 have two cuts 38 and 39 nearing the ends thereof respectively, and such cuts 38 and 39 are designed to prevent the end parts 40 of the two syringe needles from being blocked upon being plugged into the ink-storage sponge 20, and also to provide more contact area and higher speed to have he ink infiltrated into the ink-storage sponge 20.

The ink-refilling steps for the ink cartridge 11 are described as follows:

1. Stab a small hole in the center of the connector 33 of the ink bottle 30 by using a thumb pin.
2. Have the refilling needle assembly 13 connected together with the connector 33 of the ink bottle 30.
3. Before refilling the ink cartridge 11, the outlet thereof should be sealed with a glue paper.
4. Use a thumb pin to stab through the membrane 29 on the through hole 24.
5. Connect the through hole 24 of the in cartridge 11 with the refilling needle assembly 13 of the ink bottle 30 surely so as to prevent from leaking ink.
6. Let the through hole 24 of the ink cartridge 11 face upwards, and make sure that the two syringe needles 36 and 37 are plugged in place.
7. Squeeze the bottle body 31 of the ink bottle 30 once, and release it slowly; then, the ink in the ink bottle 30 will be refilled in a convection condition.
8. As soon as the ink in the ink bottle 30 does not fill in a convection condition, remove the refilling needle assembly 13 (including the ink bottle 30) slowly.
9. Attach a glue paper to the through hole 24 of the ink cartridge 11, and the refilling operation of r the ink cartridge 11 is done.

In steps 6 and 7 as mentioned above, the two syringe needles 36 and 37 plugged into the ink-storage sponge 20 have no ink to pass through; the ink in the ink bottle 30 would not flow for refilling as a result of the tension effect of the bottle body 31. When the ink bottle 30 is squeezed first time, the ink therein will flow to the end parts 40 and 41 of the two syringe needles 36 and 37, and out of the cuts 38 and 39 into the ink-storage sponge 20; then, release the bottle body 31 so as to start the ink convection and refilling operation.

When the ink bottle 30 is released, the long syringe needle 36 is plugged into the deepest spot of the ink-storage sponge 20, while the cut 39 of the short syringe needle 37 is just on the top surface of the ink-storage sponge 20, i. e., being in contact with air; then, the ambient air will be sucked into the ink bottle 30 to form into a balanced air-supply passage; simultaneously, the long syringe needle 36 plugged into the deepest spot forms into an ink passage, and the ink can flow through the cut 38 and the end part 40, and finally into the ink-storage sponge 20; in that case, the two syringe needles 36 and 37 form into a convection passage for ink.

As soon as the ink level in the ink-storage sponge 20 raises to the highest level, i.e., to the cut 39 of the short syringe needle 37, the air flows through the cut 39 will be blockaded by the ink, and the convection of ink will be discontinued; the refilling operation would not continue, even if the ink chamber has a larger capacity, the ink therein would not overflow. By means of the convection refilling method, and the ink can infiltrate into the ink-storage sponge 20 completely, and there will be no any bubble left in the ink-storage sponge 20.

After the ink cartridge 11 is refilled, remove the refilling needle assembly 13 and the ink bottle 30; the membrane 29 broken on the through hole 24 should be sealed with a glue paper so as not to affect the pressure balance inside the ink cartridge 11.

According to the present invention, the refilling needle assembly 13 includes two syringe needles 36 and 37 to be assembled together with the needle seat 34. After the two syringe needles 36 and 37 are plugged into the ink-storage sponge 20 in the ink chamber 15 of the ink cartridge 11, the convection method of refilling ink can easily be done to fill the ink-storage sponge 20 of the ink cartridge 11. Through the description of the aforesaid embodiment, the structure of the refilling needle assembly 13 and the features of the refilling method for the ink cartridge have been disclosed completely; it is apparent that the present invention has shown an obvious improvement and novelty to fulfill the objects as expected, and such features are never anticipated and achieved by an y person in the field.

What is claimed is:

1. A refilling needle assembly for refilling an ink cartridge comprising a needle seat, a long syringe needle and a short syringe needle; said needle seat connected with an ink bottle, and said long and short syringe needles plugged into an ink-storage sponge of said ink cartridge for a convection method of refilling ink, and features thereof being described as follows:

one end of said needle seat furnished with a tapered connection hole for connecting with a connector of said ink bottle, while other end thereof furnished with a plug hole for receiving said two syringe needles which being fastened together in paralleled; one end of said long syringe needle provided with a cut to be plugged into the deepest spot of said ink-storage sponge; one end of said short syringe needle also provided with a cut to be set in contact with upper surface of said ink-storage sponge during refilling operation.

2. A refilling needle assembly for refilling an ink cartridge as claimed in claim 1, wherein said long syringe needle has a length designed in accordance with inner height of said ink cartridge so as to reach bottom surface of an ink chamber of said ink cartridge upon said long syringe needle plugged into said ink-storage sponge.

3. A refilling needle assembly for refilling an ink cartridge as claimed in claim 1, wherein length of said short syringe needle is so designed as to have said cut of said short syringe needle plugged into said ink-storage sponge at a very short distance below upper surface thereof.

4. A refilling needle assembly for refilling an ink cartridge as claimed in claim 1, wherein said needle seat is made of metal, including two holes combined together for receiving said long and short syringe needles; said two holes being almost in tangent touching.

5. A refilling needle assembly for refilling an ink cartridge as claimed in claim 1, wherein said needle seat is made of plastics, including two holes combined together for receiving said long and short syringe needles.

* * * * *